US006902242B2

(12) United States Patent
Horn

(10) Patent No.: US 6,902,242 B2
(45) Date of Patent: Jun. 7, 2005

(54) APPARATUS FOR SUPPLYING ITEMS TO BE USED IN GARAGES

(75) Inventor: Jörg Horn, Schwalmstadt (DE)

(73) Assignee: Horn & Bauer GmbH & Co. KG, Schwalmstadt (DE)

( * ) Notice: Subject to any disclaimer, the term of this patent is extended or adjusted under 35 U.S.C. 154(b) by 0 days.

(21) Appl. No.: 10/284,704

(22) Filed: Oct. 31, 2002

(65) Prior Publication Data

US 2003/0090181 A1 May 15, 2003

(30) Foreign Application Priority Data

Nov. 10, 2001 (DE) ..... 101 55 343

(51) Int. Cl.[7] ..... A47F 5/08
(52) U.S. Cl. ..... 312/245
(58) Field of Search ..... 248/905, 225.21; 312/242, 245, 246, 247, 257.1, 34.1, 34.8

(56) References Cited

U.S. PATENT DOCUMENTS

| | | | | |
|---|---|---|---|---|
| 2,428,073 A | | 9/1947 | Handel | |
| 2,537,050 A | * | 1/1951 | Gluck | 220/480 |
| 3,667,597 A | * | 6/1972 | Hollister | 242/564 |
| 4,094,416 A | | 6/1978 | Smith | |
| 4,269,317 A | | 5/1981 | Rubenstein et al. | |
| 4,410,221 A | * | 10/1983 | Vallis et al. | 312/34.22 |
| 4,620,684 A | * | 11/1986 | Delpercio et al. | 248/224.8 |
| 4,796,844 A | * | 1/1989 | Barker | 248/222.51 |
| 5,022,537 A | * | 6/1991 | Henriquez | 211/88.01 |
| 5,492,398 A | * | 2/1996 | Schafer | 312/34.7 |
| 5,796,585 A | * | 8/1998 | Sugiyama et al. | 361/735 |
| 5,855,422 A | * | 1/1999 | Naef | 312/42 |

FOREIGN PATENT DOCUMENTS

| | | | |
|---|---|---|---|
| DE | 29 07 896 | | 9/1979 |
| DE | 33 31 171 | | 3/1985 |
| DE | G 89 02 641.1 | | 6/1989 |
| DE | G 93 10 908.3 | | 6/1994 |
| DE | 195 48 336 | | 6/1997 |
| EP | 0 108 739 | | 5/1984 |
| GB | 1 367 827 | | 9/1974 |
| GB | 2 036 707 | | 7/1980 |
| GB | 2037572 | * | 7/1980 |

OTHER PUBLICATIONS

Das Cornuflex Compact System brochure, 4 pages, AHB Auto–Teile, Hans Barz, (no date given).

* cited by examiner

*Primary Examiner*—James O. Hansen
(74) *Attorney, Agent, or Firm*—Thomas, Kayden, Horstemeyer & Risley, LLP

(57) ABSTRACT

An apparatus for supplying items to be used in garages includes a fixing device including two supporting elements and at least two associated suspending elements. The supporting elements include front supporting surfaces, and they are designed and arranged to approximately extend in a vertical direction and to define a vertical plane. The suspending elements have a hook-like design, they are connected to the supporting elements, and they are designed and arranged to freely protrude in a direction approximately perpendicular with respect to the vertical plane. The suspending elements are arranged to be spaced apart and to be aligned in a horizontal direction with respect to one another. At least one box is designed to transport and dispense the items. The items are located in the box in a protected and detachable way as a roll of a plurality of interconnected identical items. The box includes a rear supporting wall and two openings. The rear supporting wall is approximately flat. The openings are eccentrically arranged in the rear supporting wall, and they are associated with the suspending elements. The suspending elements engage the openings and the front supporting surfaces of the supporting elements contact the rear supporting wall of the box such that the box is suspended at the suspending elements.

19 Claims, 3 Drawing Sheets

APPARATUS FOR SUPPLYING ITEMS TO BE USED IN GARAGES

CROSS REFERENCE TO RELATED APPLICATIONS

This application claims priority to co-pending German Patent Application No. 101 55 343.9 entitled "Gestell zur Abnahme einzelner Verbrauchsartikel zum Einsatz in Kraftfahrzeug-werkstätten", filed Nov. 10, 2001.

FIELD OF THE INVENTION

The present invention generally relates to an apparatus, a fixing device and a box for supplying items to be used in garages in which automobiles are repaired, inspected and serviced. The items to be used such garages may especially be articles made of plastic foil, for example seat covers, steering wheel covers, floor carpets, trash bags, replacement parts bags, foils for sealing the interior of doors, bags for tires and the like. Usually, these items are made of plastic foil. However, especially in the case of floor carpets, the items may also be made of paper or carton. The items serve to cover and protect the respective elements of the automobiles and/or to contain replacement parts or other elements.

BACKGROUND OF THE INVENTION

An apparatus is known from the leaflet "*Das CORNUFLEX Compact System*", edition January 1985 by the Applicant. The known apparatus includes a fixing element being made of metal, namely metal bars being interconnected by welding to form two consoles. The two consoles are part of a fixing device to be connected to a wall. It is desired to connect the two consoles with a respective horizontal distance with respect to one another at a wall, for example by using plugs and screws. The fixing device also includes a number of transverse bars being supported in bearings being located at the consoles. Each transverse bar serves to support a roll on which a plurality of identical items is wound up. Due to the horizontal distance between the consoles with respect to one another, the maximum width of a roll to be located on a transverse bar to be freely rotatable is determined. In garages, rolls of articles having different widths are required. For example, a roll on which a number of interconnected floor carpets is wound up is substantially shorter than a roll on which seat covers or tire wheels are wound up. This means that the rolls of the different items have different lengths. It is also known to suspend two rolls of comparatively small lengths on one common transverse bar. The fixing devices are mounted in the garages, and the manufacturer of the items delivers the items being wound up to form a roll. The roll is wrapped up in a piece of foil to protect the roll during transport to the garage. It is also known to use an outer cardboard box to protect the roll during transport. The roll is then removed from the cardboard box, and it is suspended on the transverse bar. It is disadvantageous that the fixing device being made of metal is designed as a comparatively expensive and complicated element. Assembly of the known apparatus is rather difficult, and it requires use of a drilling jig to reliably attain the horizontal distance between the two consoles. Additionally, the maximum length of the rolls is limited by the respective horizontal distance between the two supporting elements. Since the two supporting elements have to be mounted outside of the actual length of the roll, the known fixing device is rather long. Consequently, it requires a lot of space. The known supporting elements in the form of consoles at least have to protrude from the wall such that the bearings supporting the transverse bars have a distance with respect to the wall which is more than the radius of the thickest roll to be suspended. The rolls are supported in the known apparatus in an unprotected way. This means that they are subjected to dirt, paint, mist in garages where automobiles are painted and the like. This has a negative effect on the functionality of the items. Such rolls of plastic foil tend to show frictional electricity effects, and they attract dust in the garage, the dust later being transmitted to the element of the automobile to be protected, for example a seat. Handling of the rolls requires the use of two hands and certain skills. The rolls are suspended on the transverse bars to be freely rotatable such that it is necessary to secure the roll with one hand, and to pull with the other hand to tear one item apart from the roll of items.

Such known apparatuses including a fixing device and at least a roll are not only known as wall supports—meaning to be fixed to a wall—but also in the form of stands to be located in the middle of a room. In such a case, the fixing device includes two supporting elements or columns substantially extending in a vertical direction between which transverse bars are located on which the rolls are suspended. It is to be understood that such a stand requires a complicated bottom construction to make it possible to place the apparatus in the middle of a garage. The bottom construction may also include rollers to make it possible to roll the stand inside of the garage. Such known fixing devices include two additional supporting bars being placed on the surface of the rolls and serving to stabilize the roll to a certain extent due to their weight. When two rolls of different diameters are suspended on one transverse bar, there only is support of the thicker roll. Such additional elements substantially raise the cost of the known fixing device. At the same time, there are the disadvantages which have been described above with respect to the fixing device to be connected to a wall.

It is also known to place a roll of items in an outer cardboard box to transport the roll from the manufacturer to the garage where the items will be used. The cardboard box includes a slot serving to remove the beginning of the roll. It is then possible to pull the beginning of the roll out of the cardboard box, to tear apart the respective perforation and to use the removed item in the desired way. The roll remains located in the cardboard box in a protected way during this kind of use. However, the cardboard box has to be stored somewhere in the garage. It is not possible to suspend one or more of such cardboard boxes including rolls of items in an orderly way one above the other or one next to the other.

SUMMARY OF THE INVENTION

The present invention relates to an apparatus for supplying items to be used in garages. The apparatus includes a fixing device including two supporting elements and at least two associated suspending elements. The supporting elements include front supporting surfaces, and they are designed and arranged to approximately extend in a vertical direction and to define a vertical plane. The suspending elements have a hook-like design, they are connected to the supporting elements, and they are designed and arranged to freely protrude in a direction approximately perpendicular with respect to the vertical plane. The suspending elements are arranged to be spaced apart and to be aligned in a horizontal direction with respect to one another. At least one box is designed to transport and dispense the items. The items are located in the box in a protected and detachable way as a roll of a plurality of interconnected identical items. The box includes a rear supporting wall and two openings.

The rear supporting wall is approximately flat. The openings are eccentrically arranged in the rear supporting wall, and they are associated with the suspending elements. The suspending elements engage the openings and the front supporting surfaces of the supporting elements contact the rear supporting wall of the box such that the box is suspended at the suspending elements.

The present invention also relates to a fixing device for supplying items to be used in garages. The fixing device includes two supporting elements. The supporting elements each include a front supporting surface. The supporting elements are designed and arranged to approximately extend in a vertical direction and to define a vertical plane. The fixing device additionally includes at least two suspending elements. The suspending elements are connected to the supporting elements. The suspending elements have a hook-like design. The suspending elements are designed and arranged to freely protrude in a direction approximately perpendicular with respect to the vertical plane. The suspending elements are arranged to be spaced apart and to be aligned in a horizontal direction with respect to one another. The suspending elements are designed and arranged to be connectable to two openings being located in a rear supporting wall of a box in which items to be used in garages are located in a protected and detachable way as a roll of a plurality of interconnected identical items, the front supporting surfaces of the supporting elements being designed and arranged to contact the rear supporting wall of the box such that the box may be suspended at the suspending elements The present invention also relates to a box for transporting and supplying items to be used in garages. The box includes a rear supporting wall being approximately flat and two openings being eccentrically arranged in the rear supporting wall and being designed and arranged to be connectable to suspending elements of a fixing device such that the rear supporting wall contacts a front supporting surface of the supporting elements of the fixing device and the box is suspended at the fixing device. The box also includes a roll of a plurality of interconnected identical items being located in the box in a protected and detachable way.

With the novel apparatus, the novel fixing device and the novel box, it is possible to arrange a plurality of rolls of different items in an orderly and protected way. It is especially easy to remove single items from the roll. The novel fixing device may be produced at comparatively low production cost. With the novel apparatus, the functions to be fulfilled by the components of the apparatus are now fulfilled by different elements than it is known in the prior art. The basic concept is to use the cardboard box in which a single roll of one kind of item is located as a part of the fixing device. In this way, the fixing device may have a substantially less complicated design. It is less long in a horizontal direction, the length not being dependent from the radius of the respective roll. The extension of the fixing device in this direction may be in a range of approximately between 1 and 2 cm. The cardboard box is designed as a transportation and dispenser box, meaning a box not only fulfilling a function during transportation, but also to protect the roll until all items have been used such that the content of the transportation and dispenser box is protected from dust, dirt and the like. A part of the transportation and dispenser box forms a part of the fixing device. Due to the eccentric suspension of the transportation and the dispenser box, the fact of gravity onto the roll is used for stabilizing purposes. The roll is no longer suspended in its center region, but it is supported by the flat rear supporting wall of the transportation and dispenser box. There are two openings being located in the flat rear supporting wall of the cardboard box. The "hanging" support is realized by hook-like suspending elements protruding through the eccentric openings. The openings may already be located in the wall of the box, or they may be prepared by partly cuts, perforations and the like to fully protect the roll being located in the cardboard box during transportation. The supporting elements form supporting surfaces being designed and arranged to support the supporting wall of the eccentrically suspended transportation and dispenser box. Due to the eccentric suspension of the transportation and dispenser box, gravity is used for stabilizing purposes. The transportation and dispenser box is located very close to the supporting elements. A special clearance or coordination with the respective roll having the greatest diameter (in the case of a plurality of rolls of different diameters being suspended) is not necessary. The novel apparatus advantageously has a shorter horizontal length than the length of the rolls. This means that the required space in this direction is also less than in the known apparatus of the prior art. Eccentric suspension of the transportation and dispenser box may also be used with a special advantage when it is desired to commonly suspend a plurality of transportation and dispenser boxes, also such ones having different horizontal lengths.

The fixing device may include a plurality of pairs of suspending elements, the suspending elements being arranged at the supporting elements in a vertically spaced apart manner, and wherein a plurality of transportation and dispenser boxes including different items are suspended at the suspension elements one above the other. For each transportation and dispenser box, one pair of hook-like suspending elements is required. These two hook-like suspending elements of each pair are arranged to be spaced apart in a horizontal direction, and they each serve to support one of the two openings being located in the respective transportation and dispenser box. A plurality of such pairs of hook-like suspending elements may be spaced apart in a vertical direction at certain repeating distances or also at different vertical distances. In this way, a plurality of such transportation and dispenser boxes may be suspended one above the other.

It is preferred that the two suspending elements of each pair of suspending elements or suspension elements are arranged at the supporting elements at the same horizontal distance, and that the two openings being located in the rear supporting walls are also located at this distance. One single horizontal distance is determined, the distance being less than the shortest transportation and dispenser box. It is to be understood that these openings are located symmetrically with respect to have the length of the transportation and dispenser box. The hook-like suspension elements are located at the same distance. Consequently, it is up to the user to decide which transportation and dispenser box to be arranged in the lowermost place or at a different position.

When the two supporting elements of the fixing device are fixedly interconnected, there is no necessity of using a drilling jig. The fixing device with its two supporting elements forms a fixed unit such that the fixing device itself may be easily used for indicating the bores to be drilled for mounting the fixing device by plugs and screws. In the case of the two supporting elements not being connected, they have to be fixed at such a horizontal distance with respect to one another that the predetermined horizontal distance between the hook-like suspension elements of the respective pair is maintained. On the one hand, a fixed connection is easier to be handled, and on the other hand, it further stabilizes the fixing device.

The suspending elements may include a horizontal portion and a vertical portion. The vertical portion is designed and arranged to freely protrude with respect to the supporting elements by a distance which is slightly more than the thickness of the material of the supporting wall of the transportation and dispenser box. Consequently, console-like protruding of the fixing device with the hook-like suspension elements is limited to a few millimeters or approximately in a range of 1 cm. The eccentric suspension of the transportation and dispenser box is realized in a way that these boxes may be suspended one above the other and aligned at the rear supporting walls even when having different diameters of the rolls. These different diameters have no negative effect.

The two openings being located in the supporting wall of each transportation and dispenser box may be located in the upper portion, meaning they are arranged to be displaced in an upward direction in the region of the supporting wall of the transportation and dispenser box independent from the position of the center of the roll.

The vertical portions of the suspending elements may have a height which is less or which equals the distance of the upper edge of the opening with respect to a cover wall of the transportation and dispenser box. In other words, the height is not more. In the case of the height being approximately identical to the distance, two portions are used for eccentrically supporting the transportation and dispenser box at the same time. This means that the upper edge of the opening and the lower inner surface of the upper wall of the transportation and dispenser box are used. However, it is not necessarily required to locate the upper wall on the upper end of the vertical portion. It is also sufficient to support the upper edge of the opening on the horizontal portion of the suspension element and vice versa. The size of the opening preferably is chosen such that the hook-like suspension element may be easily moved through the opening such that it is easily possible to suspend a full transportation and dispenser box as well as to remove an empty box after having consumed all items on the roll. It is imaginable that each transportation and dispenser box may be replaced independent from the other suspender transportation and dispenser boxes.

There is a number of possibilities of realizing the openings being located in the supporting walls. The openings may be formed by sections already punched in the first place. It is also possible and advantageous to form the openings being located in the supporting walls of the transportation and dispenser boxes as perforated sections such that the openings are finally realized by pressing or tearing the sections. Such an arrangement has the advantage of the transportation and dispenser box protecting the roll against dirt, dust and the like during the entire transportation, and that the openings may be realized shortly before suspending the transportation and dispenser box.

It makes sense if the transportation and dispenser box includes a slot having a length corresponding to the length of the roll, the slot being designed and arranged. to pull the items out off the transportation and dispenser box. This slot may also be formed by a perforated U-like line and the like being located in the transportation and dispenser box. The slot itself is then produced when suspending the transportation and dispenser box at the fixing device, and the beginning of the path of items being wound up on the roll are pulled out through the slot to a certain extent. It is rather common to arrange the items on the roll. However, the items may also be arranged in the box in different ways, for example in a fanfold way, in a stacked way one above the other and the like. Instead of using a slot for pulling out the items, the transportation and dispenser box may also include a cover-like flap making it possible to access the items.

It is to be understood that the present invention is related to an apparatus including a fixing device and at least one transportation and dispenser box. However, whereas the fixing device usually is only once required in a garage, there is a repeating need for transportation and dispenser boxes including different items. Consequently, the present invention also relates to the single elements of the apparatus.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
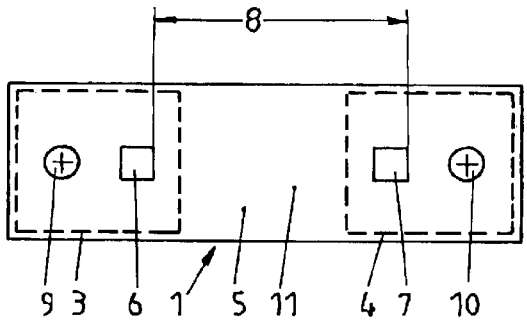
FIG. 1 is a top view of a first exemplary embodiment of the novel fixing device.

Referring now in greater detail to the drawings, FIG. 1 illustrates a part of a novel apparatus 100 (FIG. 14) for supplying articles for the protection of automobiles and parts of automobiles, respectively. The apparatus 100 includes a fixing device 1, as it is for example illustrated in FIGS. 1, 3, 8 and 12, and at least one transportation and dispenser box 2, as it is illustrated in FIGS. 2, 4, 9, 10, 11 and 13. Preferably, the novel apparatus 100 includes a plurality of such boxes 2.

The fixing device 1 includes two supporting elements 3, 4. The supporting elements 3, 4 substantially extend in a vertical direction. The outline of the supporting elements 3, 4 is illustrated by a broken line. According to the embodiment illustrated in FIG. 1, the supporting elements 3 and 4 are combined to form a supporting plate 5. The supporting element 3 includes a hook-like suspending element 7. The two hook-like suspending elements 6 and 7 are associated with one another, meaning they are aligned in a horizontal direction with respect to the supporting plate 5. The two suspending elements 6 and 7 form a pair of suspending elements, and they are located at a horizontal distance 8 with respect to one another. Each element 3, 4 and the supporting plate 5, respectively, includes, for example, two openings 9, 10 for connecting the supporting plate 5 at a wall by a plug and a screw. The supporting plate 5 is designed as a flat and substantially even piece of metal, for example sheet metal. The front surface of the supporting plate 5 forms a supporting surface 11. The supporting surface 11 may also be formed by parts of the supporting plate 5 or of the supporting elements 3 and 4.

Figure 5:
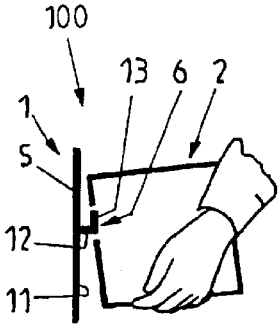
FIG. 5 is a schematic side view during the process of connecting a transportation and dispense box at a fixing device.

As it may be especially seen from FIG. 5 each suspending element 6 includes a horizontal portion 12 and a vertical portion 13. The horizontal portion 12 is connected to the vertical portion 13 in an approximately perpendicular way. The entire suspending element 6 protrudes with respect to the front and to the supporting surface 11, respectively, of the supporting plate 5 only by small extent, as this is to be seen in FIGS. 5 and 6. The design and arrangement of the horizontal element 12 and of the vertical element 13 with respect to one another are such that the vertical element 13 freely protrudes in an upward direction to be more or less aligned in a vertical direction with respect to the supporting surface 11.

Figure 2:
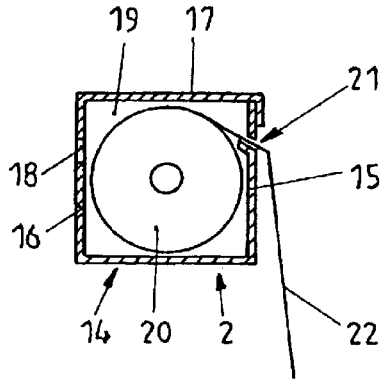
FIG. 2 is a vertical sectional view through a novel transportation and dispenser box.

FIG. 2 illustrates a first exemplary embodiment of a respective box 2. The transportation and dispenser box 2 is formed by an outer box 14. The outer box 14 is an elongated box having an approximately square cross section. It includes a total number of six side walls including a front wall 15, a flat rear supporting wall 16 and a cover wall 17. Two openings 18 are located in the rear supporting wall 16 facing the fixing element 1 and the supporting elements 3 and 4, respectively. The openings 18 are designed and arranged such that the box 2 with these openings 18 may be suspended on the suspending elements 6 and 7. In this way, the vertical portions 13 and a part of the respective horizontal portion 12 of the suspending elements 6 and 7 partly enter the interior 19 of the box 12 by the openings 18, as this may be clearly seen in FIG. 6. It is to be understood that the two openings 18 are located at the transportation and dispenser box 2 in a horizontally aligned way and at a distance corresponding to the distance 8.

A roll 20 is located in the interior 19 of the transportation and dispenser box 2. The roll 20 is a wound up path of interconnected single consumable products, as for example seat covers. The articles are interconnected by perforation elements such that the articles may be detached by these perforations. A horizontal slot 21 is located in the front wall 15. The slot 21 may also be formed by a flap or the like. In this way, there is the possibility of pulling the free end of the roll 20 with the first item 22 through the slot 21 in an outward direction, and to detach the item 22 when required, as this is clearly illustrated in FIG. 7. The roll 20 may be designed not to include a core, or it may be wound up on a cylindrical element. Items of different kinds usually have different lengths such that it is necessary to use different transportation and dispenser boxes 2 also having different lengths. It may also be seen from FIG. 2 that the openings 18 are arranged in the upper portion of the rear supporting wall 16.

Figure 3:
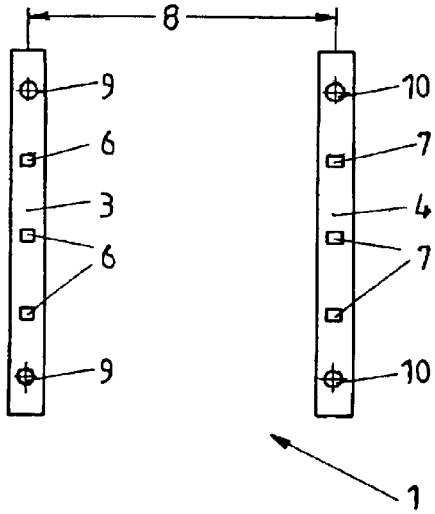
FIG. 3 is a view of another exemplary embodiment of the novel fixing device.
Figure 4:
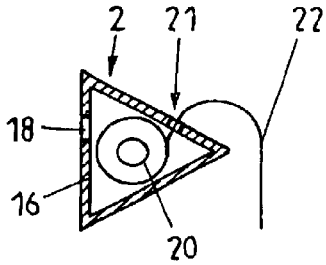
FIG. 4 is a vertical sectional view through another exemplary embodiment of the novel transportation and dispenser box.

It may be seen in FIG. 3 that it is preferred to only use one distance 8 in a horizontal direction independent from the different entire length of the respective transportation and dispenser boxes 2. However, it is also possible (see FIG. 8) to arrange the suspending elements 6 and 7 being associated with one another to be located at different distances. Consequently, there will be respectively different distances between the openings 18 at the different transportation and dispenser boxes 2. The second embodiment is more directed to placing the transportation and dispenser boxes 2 in a predetermined order one above the other, whereas the embodiment of FIG. 3 is more directed to freely choosing the arrangement of the boxes 2 one above the other. According to FIG. 8, the two elements 3 and 4 are fixedly interconnected by a center portion 23 such that the openings 9 and 10 are located at the fixing device 1 at a predetermined fixed distance. In this way, drilling the holes for a wall assembly is even more simplified since the respective distances 8 are automatically achieved. It is to be understood that such a center portion 23 may also be part of the first exemplary embodiment according to FIG. 3. The exemplary embodiment of the novel apparatus 100 according to FIG. 8 includes two pairs of suspending elements 6, 7 for each transportation and dispenser box 2. Correspondingly, there are two pairs of openings 18 and 24 being located in the rear supporting wall 16. The horizontal position and arrangement of the openings 18 and 24 is coordinated with the apparatus 100 according to FIG. 8. The respective transportation and dispenser box 2 according to FIG. 9 includes the slot 22 being located in the region of the cover wall 17. It is also possible that there is a flap and the like to make it possible to access the roll 20.

Figure 10:
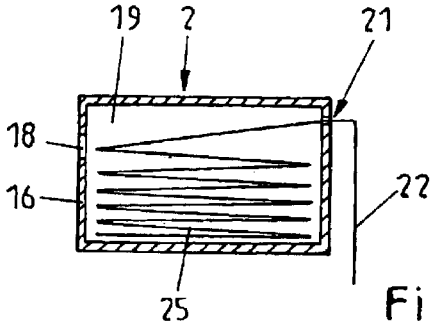
FIG. 10 is a view of a transportation and dispenser box with an item being fanfold.
Figure 11:
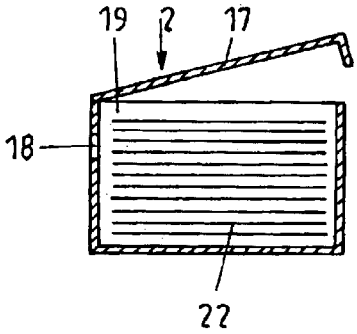
FIG. 11 is a view of a transportation and dispenser box including piled up items.

FIGS. 10 and 11 illustrate additional exemplary embodiments of the transportation and dispenser box 2. According to FIG. 10, a fanfold elongated element 25 is located in the interior 19. In the embodiment of FIG. 11, the cover wall 17 is designed as a cover. The articles 22 are designed as separate items being located as a stack in the interior 19 of the transportation and dispenser box 2. The boxes 2 according to FIGS. 10 and 11 may also be connected to the fixing element 1 by the openings 18, as this has been described above.

Figure 12:
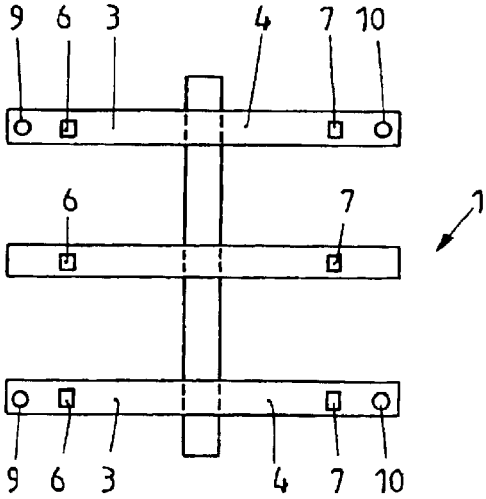
FIG. 12 is a view of another exemplary embodiment of the novel fixing device.

FIG. 12 illustrates another exemplary embodiment of the novel fixing device 1. In this case, the dispending elements 3 and 4 are connected in a horizontal and in a vertical position to form one single piece. The supporting surfaces 11 for supporting the transportation and dispenser box 2 are formed by the vertical connecting portion. The vertical connecting portion is not necessarily required. In such a case, the elements 3 and 4 may be designed as separate elements extending in a horizontal direction (similar to FIG. 1) and to be arranged at the wall one above the other. In such a case, the wall functions as the supporting surfaces 11. The suspended transportation and dispenser boxes 2 in the suspended position reach a certain angled position not having a negative influence on the functionality, but not looking quite as good as the vertically aligned position. It is also possible to realize the novel apparatus 100 to include stands not being connected to a wall. Such an apparatus 100 includes the fixing device 1 including the elements 3 and 4, and additionally supporting legs or feet. Such a stand may also be designed for engagement of transportation and dispenser boxes from two sides.

Figure 6:
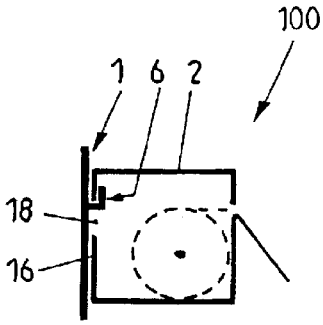
FIG. 6 is a schematic side view of the novel apparatus during use.
Figure 7:
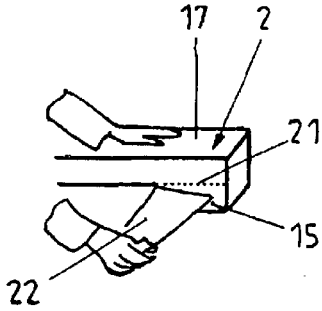
FIG. 7 is a perspective view during the process of detaching an article after pulling the article out of the transportation and dispenser box.
Figure 8:
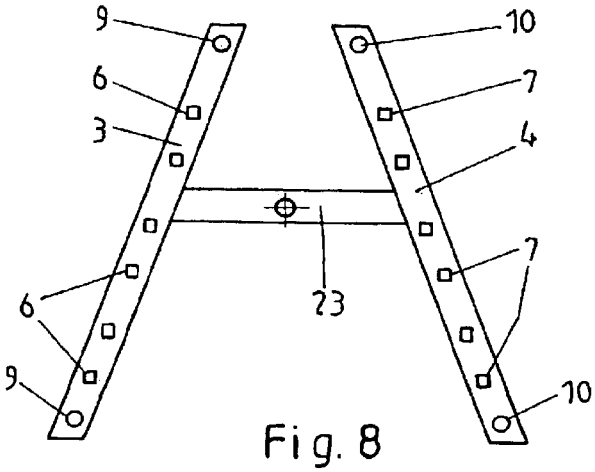
FIG. 8 is a view of another exemplary embodiment of the novel fixing device.
Figure 9:
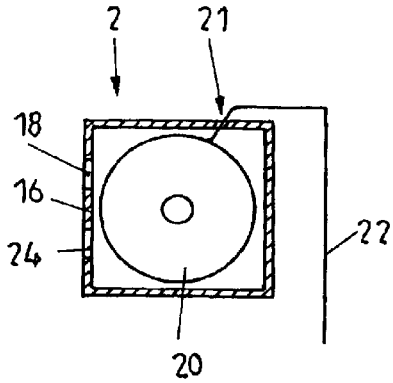
FIG. 9 is a vertical sectional view through another exemplary embodiment of the transportation and dispenser box.

FIGS. 5, 6 and 7 emphasize how the novel apparatus 1 including the fixing device 1 and the transportation and dispenser box 2 is used. It may be seen from FIG. 5 that the suspending elements 6 and 7 only protrude to a small extent, as it is required by the thickness of the material of the rear supporting wall 16 of the transportation and dispenser box 2. It is desired to take a certain clearance into account, the clearance allowing for easy and reliable suspension of the boxes 2. Due to the fact that the openings 18 are displaced in an upward direction, meaning outside of the center of the roll 20, the suspending elements 6 and 7 may use this free space for suspension without the roll 20 being damaged. FIG. 6 illustrates a position after a certain period of time of using the items. Consequently, a certain number of items 22 has been pulled out and removed from the box 2. The diameter of the roll 20 has decreased. The roll 20 may freely move in the transportation and dispenser box 2, as this is required for removal of the items 22.

Figure 13:
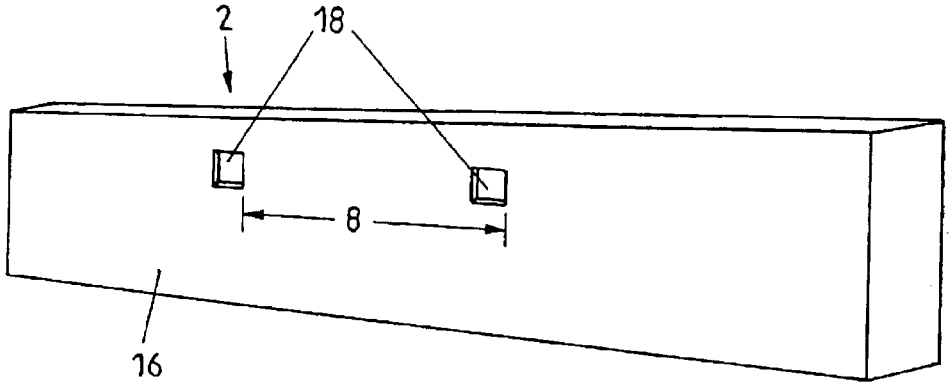
FIG. 13 is a perspective view of the rear supporting wall of a transportation and dispenser box.

FIG. 13 clearly shows the transportation and dispenser box 2 and the arrangement of the two openings 18 being located in the rear supporting wall 16.

Figure 14:
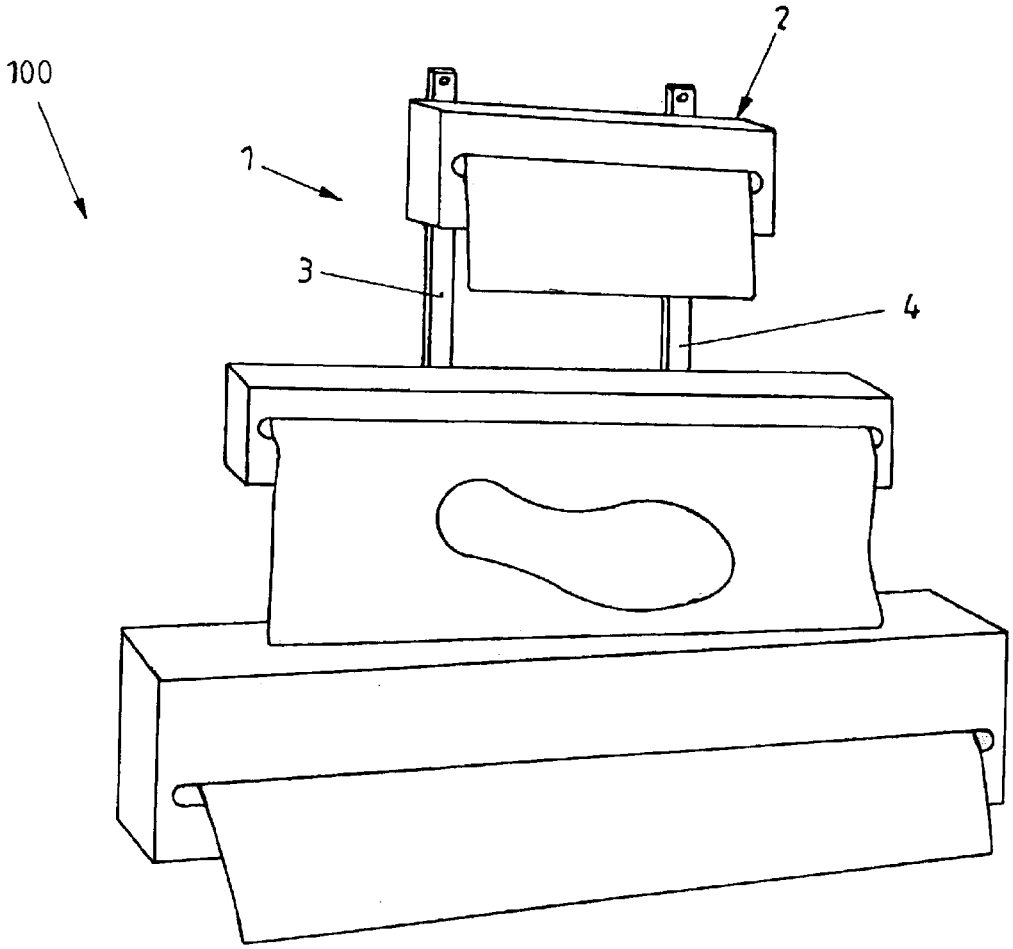
FIG. 14 is a perspective view of the novel apparatus for detachment to a wall including a fixing device and three transportation and dispenser boxes.

FIG. 14 illustrates the novel apparatus 100 being ready to be used. The fixing device 1 is mounted to a wall of a garage. This illustration only shows the elements 3 and 4. In the illustrated case, there are three different transportation and dispenser boxes 2. The uppermost box 2 is designed to receive steering wheel covers. The middle transportation and dispenser box 2 includes a roll of floor carpets, and the lowermost transportation and dispenser box 2 having the greatest length includes seat covers.

Many variations and modifications may be made to the preferred embodiments of the invention without departing substantially from the spirit and principles of the invention. All such modifications and variations are intended to be included herein within the scope of the present invention, as defined by the following claims.

I claim:

1. An apparatus with items supplied and to be used in garages, comprising:

a fixing device including two supporting elements and at least two associated suspending elements, said supporting elements including front supporting surfaces and being designed and arranged to approximately extend in a vertical direction and to define a vertical plane, said suspending elements having a hook shaped design, being connected to said supporting elements and being designed and arranged to freely protrude in a direction approximately perpendicular with respect to the vertical plane, said suspending elements being arranged to be spaced apart and to be aligned in a horizontal direction with respect to one another; and at least one box being designed to transport and dispense said items, said items being located in said box in a protected and detachable way as a roll of a plurality of interconnected identical items, said box including a rear supporting wall and two openings, said rear supporting wall being approximately flat, said openings being eccentrically arranged in said rear supporting wall and being associated with said suspending elements, said suspending elements engaging said openings and said front supporting surfaces of said supporting elements contacting said rear supporting wall of said box such that said box is suspended at said suspending elements, said box including a slot having a length and said roll has a width, the length of said slot corresponding to the width of said roll, said slot being designed and arranged to facilitate pulling said items out of said box.

2. The apparatus of claim 1, wherein said fixing device includes a plurality of two associated suspending elements being arranged as pairs, said pairs of suspending elements being arranged at said supporting elements to be vertically spaced apart.

3. The apparatus of claim 2, further comprising a plurality of boxes each including different items and two openings to be suspended at said pairs of suspending elements one above the other.

4. The apparatus of claim 3, wherein said two suspending elements of each pair of suspending elements are arranged at said supporting elements at the same horizontal distance, and wherein said associated two openings are also located at this horizontal distance.

5. The apparatus of claim 4, wherein said two supporting elements are fixedly interconnected.

6. The apparatus of claim 3, wherein said two supporting elements are fixedly interconnected.

7. The apparatus of claim 2, wherein said two supporting elements are fixedly interconnected.

8. The apparatus of claim 1, wherein said two supporting elements are fixedly interconnected.

9. The apparatus of claim 1, wherein each of said suspending elements includes a horizontal portion and a vertical portion, said vertical portion being designed and arranged to be spaced apart from said supporting elements by a distance being slightly more than the thickness of the material of said rear supporting wall of said box.

10. The apparatus of claim 9, wherein said openings have an upper edge and said box includes a cover wall, said two openings being located in an upper portion of said rear supporting wall, said vertical portion having a height not being more than a distance between the upper edge and said cover wall.

11. The apparatus of claim 1, wherein said two openings are formed by perforated sections.

12. The apparatus of claim 11, wherein said perforated sections are designed to be removed by pushing trough to attain said openings.

13. The apparatus of claim 11, wherein said perforated sections are designed to be removed by tearing off to attain said openings.

14. An apparatus for supplying protective sheet items to be used in garages to protect vehicle surfaces for maintenance and repair, comprising:

a fixing device including at least one supporting plate configured for mounting in an upright attitude and at least two suspending elements supported by said supporting plate and spaced horizontally from each other and extending away from said supporting plate, said suspending elements each having a horizontal portion mounted to said supporting plate and a vertical portion extending upwardly from said horizontal portion and spaced from said supporting plate, at least one disposable transportation box for containing and shipping the protective sheet items that functions as a dispenser for mounting on said fixing device, said box having opposed walls forming a closed interior, said opposed walls including opposed front and rear walls, said rear wall of said box defining therein at least two horizontally aligned openings spaced from each other at intervals that correspond to the spacing of said suspending elements of said fixing device for facing said supporting plate such that the openings of said rear wall of said box register with said suspending elements at the supporting plate and said box is suspended by said suspending elements adjacent the supporting plate, said front wall of said box defining an elongated horizontal slot facing away from the supporting plate when said box is suspended by said suspending elements, a supply of a plurality of interconnected duplicate protective sheet items connected to one another in series positioned in the interior of said box with an end-most item extendable from the interior of said box through said horizontal slot, said horizontal slot being of a length that is substantially the same dimension as the width of said the supply of said protective sheet items to facilitate the withdrawal of the end most sheet item from the supply of sheet items in a substantially flat configuration from the interior of the box through the slot and the next sheet item advances partially through said slot, and said horizontal slot being of a width that is smaller than the breadth of the supply of said sheet items in the interior of the box to retard the withdrawal of more than one sheet item at a time from the box.

15. The apparatus of claim 14, wherein said fixing device includes a plurality of pairs of suspending elements for suspending several boxes at a time in a vertical array of boxes.

16. The apparatus of claim 14, wherein said supply of plurality of duplicate protective sheet items in the interior of said box formed in a roll.

17. The apparatus of claim 16, wherein the roll of sheet items has a center portion and the openings in the rear wall of said box are located higher than the center portion such that the suspending elements protrude into the interior of the box at a position above the center of the roll.

18. The apparatus of claim 14, wherein said supply of plurality of duplicate protective sheet items in the interior of said box formed in a fan folded configuration.

19. The apparatus of claim 14, wherein said supply of plurality of duplicate protective sheet items in the interior of said box formed in a stacked way.

* * * * *